US010069269B2

(12) United States Patent
Takahashi

(10) Patent No.: US 10,069,269 B2
(45) Date of Patent: Sep. 4, 2018

(54) CONNECTOR WITH STRUCTURE FOR FIRMLY RETAINING THE INNER HOUSING

(71) Applicant: YAZAKI CORPORATION, Tokyo (JP)

(72) Inventor: Takakazu Takahashi, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/672,592

(22) Filed: Aug. 9, 2017

(65) Prior Publication Data

US 2018/0048108 A1 Feb. 15, 2018

(30) Foreign Application Priority Data

Aug. 10, 2016 (JP) ..... 2016-157572

(51) Int. Cl.
*H01R 9/03* (2006.01)
*H01R 43/20* (2006.01)

(52) U.S. Cl.
CPC ..... *H01R 43/20* (2013.01)

(58) Field of Classification Search
CPC ..... H01R 13/504; H01R 13/658
USPC ..... 439/607.5, 607.51, 607.41, 585, 903
See application file for complete search history.

(56) References Cited

U.S. PATENT DOCUMENTS 7,677,936 B2 * 3/2010 Sato ..... H01R 13/506 439/357
2004/0171313 A1 9/2004 Muro et al.
2004/0266271 A1 12/2004 Matsuoka et al.
2012/0208400 A1 8/2012 De Chazal et al.
2015/0295361 A1 * 10/2015 Miyoshi ..... H01R 13/502 439/607.58

FOREIGN PATENT DOCUMENTS

| | | | |
|---|---|---|---|
| JP | 10-241790 | A | 9/1998 |
| JP | 11-339891 | A | 12/1999 |
| JP | 2000-156261 | A | 6/2000 |
| JP | 2004-259654 | A | 9/2004 |
| JP | 2005-19020 | A | 1/2005 |
| JP | 2014-509055 | A | 4/2014 |
| JP | 2016-18720 | A | 2/2016 |

OTHER PUBLICATIONS

Communication dated Jun. 26, 2018 from the Japanese Patent Office in counterpart application No. 2016-157572.

* cited by examiner

*Primary Examiner* — Phuong Dinh
(74) *Attorney, Agent, or Firm* — Sughrue Mion, PLLC

(57) ABSTRACT

A connector includes an inner housing configured to accommodate and hold terminals that are crimped onto respective ends signal wires, a shielding shell formed in a tubular shape that is attachable to the inner housing, and an outer housing having an inner housing holding portion configured to hold the inner housing inside the inner housing holding portion. The shielding shell is configured to be detachably attached to the inner housing. The inner housing has a looseness suppressing structure between the inner housing and an inner surface of the inner housing holding portion. The looseness suppressing structure is configured to allow the inner housing to be held inside the inner housing holding portion without looseness when the shielding shell is attached to the inner housing and also when the shielding shell is not attached to the inner housing.

6 Claims, 11 Drawing Sheets

CONNECTOR WITH STRUCTURE FOR FIRMLY RETAINING THE INNER HOUSING

CROSS-REFERENCE TO RELATED APPLICATION

The present application claims priority from Japanese Patent Application No. 2016-157572 filed on Aug. 10, 2016, the entire content of which is incorporated herein by reference.

FIELD OF INVENTION

The present invention relates to a connector connected to a twisted pair cable or a shielded cable which is a transmission cable.

RELATED ART

Conventionally, a twisted pair cable formed of a pair of signal wires twisted together and a shielded cable formed of a twisted pair cable having a shield conductor such as a braid on its outside have been used as transmission cables.

For electrical connection between transmission cables, a connector is used. In a connector of an information communication system, a twisted pair cable or a shielded cable is used depending on a transmission speed, and when the transmission speed is higher than 1 gigabits per second (Gbps), a shielding shell is provided as a measure against noise. For example, JP2000-156261A discloses a related art shielded connector connected to terminals of a shielded cable and having a shielding shell.

The related art shielded connector includes terminals electrically connected to signal wires of a multicore shielded electric cable (shielded cable), an insulation housing (inner housing) holding the terminals inside the insulation housing, a relay terminal having one end held at the outer surface of the insulation housing and the other end portion to which the braid of the multicore shielded electric cable is electrically connected, a shielding shell fitted on the insulation housing and in electrical contact with the one end portion of the relay terminal, terminals connected to the signal wires, and a waterproof housing (outer housing) holding the insulation housing inside the waterproof housing in a state in which the relay terminal, the shielding shell and the like are attached to the insulation housing.

When the insulation housing to which the terminals, the relay terminal, the shielding shell and the like are attached is inserted into the cavity from the insertion hole of the waterproof housing, the cut and raised piece of the shielding shell is locked by a locking protrusion of the cavity, whereby the insulation housing is held inside the cavity of the waterproof housing.

Generally, when the transmission speed is 1 Gbps or lower, the shielding shell is not included as a component of a connector. Therefore, different connector housings have been used depending on the presence or absence of the shielding shell, which increases the number of connector components.

The cavity of the related art outer housing is configured to accommodate and hold the inner housing to which the shielding shell is attached. Thus, when the inner housing with no shielding shell attached thereto is placed in the cavity, the inner housing plays and cannot be held in place inside the cavity.

Moreover, when attaching the inner housing and the outer housing together, the cut and raised piece of the shielding shell fitted on the inner housing is locked by the locking protrusion of the cavity of the outer housing (primary locking). However, there is no space for providing a structure that further locks the inner housing and the outer housing by a locking member such as a spacer (secondary locking). Therefore, for example, when the shielded cable is pulled with the inner housing and the outer housing assembled together, there are cases where the holding force of the inner housing against the pulling is insufficient.

SUMMARY

Illustrative aspects of the present invention provide a connector that is capable of holding an inner housing inside an outer housing without looseness irrespective of presence or absence of a shielding shell and with which the number of components can be reduced by sharing the inner housing and the outer housing.

According to an illustrative aspect of the present invention, a connector includes an inner housing configured to hold terminals inside the inner housing, the terminals being crimped onto respective ends of a plurality of signal wires, a shielding shell formed in a tubular shape that is attachable to the inner housing, and an outer housing having an inner housing holding portion configured to hold the inner housing inside the inner housing holding portion. The shielding shell is configured to be attached to the inner housing or detached from the inner housing depending on a transmission speed of the connector. The inner housing has a looseness suppressing structure between the inner housing and an inner surface of the inner housing holding portion, the looseness suppressing structure being configured to allow the inner housing to be held inside the inner housing holding portion without looseness when the shielding shell is attached to the inner housing and also when the shielding shell is not attached to the inner housing.

By providing the looseness suppressing structure between the inner housing and the inner housing holding portion, the inner housing is held inside the inner housing holding portion without looseness irrespective of whether the shielding shell is attached to the inner housing or not. Further, by sharing the inner housing and the outer housing, the number of components can be reduced.

The shielding shell may have at least one engagement hole provided through an outer surface of the shielding shell, and the looseness suppressing structure may include at least one looseness suppressing protrusion provided on the outer surface of the inner housing, the at least one looseness suppressing protrusion being configured to engage with the engagement hole when the shielding shell is attached to the inner housing and to abut on the inner surface of the inner housing holding portion to suppress play of the inner housing when the inner housing is accommodated inside the inner housing holding portion.

When the shielding shell is attached to the inner housing, the looseness suppressing protrusion engages with the engagement hole of the shielding shell. Moreover, when the inner housing is accommodated inside the inner housing holding portion, the looseness suppressing protrusion abuts on the inner surface of the inner housing holding portion.

Since the looseness suppressing protrusion abuts on the inner surface of the inner housing holding portion, play of the inner housing in the inner housing holding portion can be suppressed.

The at least one looseness suppressing protrusion may include a plurality of looseness suppressing protrusions provided on the outer surface of the inner housing and arranged along an axial direction of the inner housing.

With this configuration, play of the inner housing is suppressed at a plurality of locations along the axial direction of the inner housing. Therefore, even when a force that shakes the inner housing acts on the inner housing held inside the inner housing holding portion, play due to the action of such a force (play in a shaking manner) can be suppressed.

The inner surface of inner housing holding portion may include a flat surface portion, and the at least one looseness suppressing protrusion may have a flat distal surface that conforms to the flat surface portion of the inner surface of the inner housing holding portion.

The looseness suppressing protrusion having the flat distal surface abuts on the flat surface portion of the inner surface of the inner housing holding portion.

Since the distal surface of the looseness suppressing protrusion formed so as to be flat in conformity with the flat surface portion of the inner surface of the inner housing holding portion stably abuts on the flat surface portion of the inner surface of the inner housing holding portion, play of the inner housing in the inner housing holding portion can be more reliably suppressed.

The looseness suppressing structure may include an engagement protrusion provided on the outer surface of the inner housing, and the outer housing may include an engagement tongue provided on the inner surface of the inner housing holding portion to engage with the engagement protrusion.

When the inner housing is accommodated in the inner housing holding portion, the engagement protrusion of the inner housing and the engagement tongue of the inner housing holding portion engage with each other.

Since the engagement protrusion of the inner housing and the engagement tongue engage with each other in the inner housing holding portion, play of the inner housing in the inner housing holding portion can be more reliably suppressed.

The connector may further include a locking member attachable to the inner housing and the outer housing, the locking member including a locking portion configured to abut, when the locking member is attached to the inner housing and the outer housing, on the at least one looseness suppressing protrusion to lock the at least one looseness suppressing protrusion.

Since the locking portion of the locking member locks the looseness suppressing protrusion, for example, even when a pulling force acts on a transmission cable attached to the connector with the inner housing and the outer housing being assembled, the holding force of the inner housing against the pulling force can be improved.

DETAILED DESCRIPTION

Hereinafter, a connector according to an embodiment of the present invention will be described with reference to the drawings.

The arrows in the figures indicate the vertical, horizontal and front-rear directions (the directions of the arrows are an example).

Figure 1:
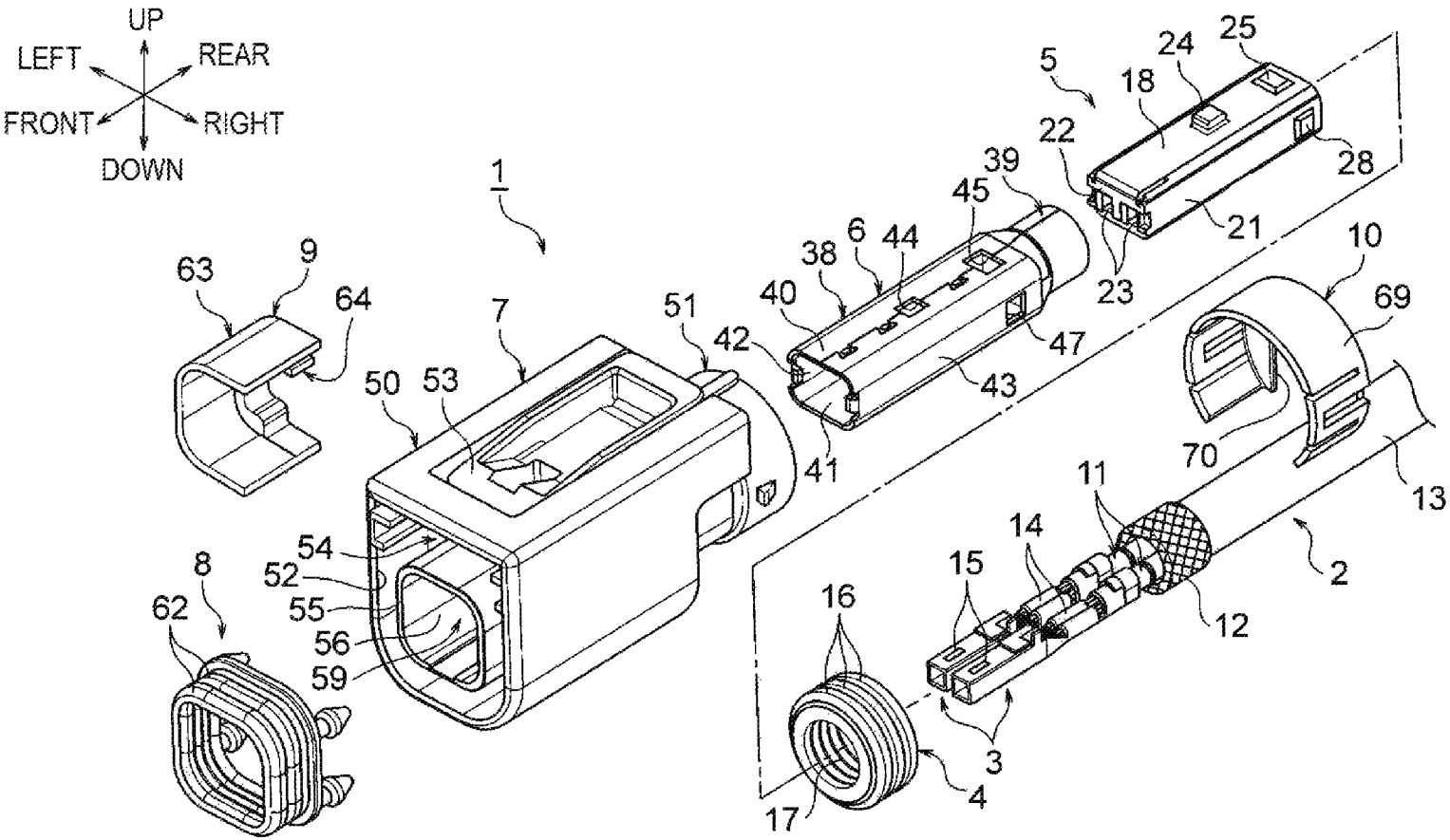
FIG. 1 is an exploded perspective view showing a connector of the present invention.

A connector 1 according to the embodiment of the present invention shown in FIG. 1 is structured, although not specifically limited, so as to transmit electric signals by electrically connecting through a shielded cable to control portions of various electric components mounted on a vehicle or the like in the present embodiment.

In the present embodiment, the connector 1 is a female connector. As shown in FIG. 1, the connector 1 includes a shielded cable 2, terminals 3, a watertight plug 4, an inner housing 5, a shielding shell 6, an outer housing 7, a sealing member 8, a locking member 9 and a rear cover 10. Hereinafter each component of the connector 1 will be described.

First, the shielded cable 2 will be described.

As shown in FIG. 1, the shielded cable 2 includes a plurality of (two in the present embodiment) signal wires 11, a braid 12 provided on the signal wires 11 and a sheath 13 formed on the braid 12 to cover the braid 12. The shielded cable 2 is configured such that the braid 12 and the sheath 13 are peeled off so that the signal wires 11 are exposed at the terminal portion.

Although not illustrated in the drawings, each signal wire 11 has a conductor and an insulator covering the conductor. The signal wires 11 are twisted together at the part covered with the braid 12 and the sheath 13, and are untwisted at the exposed part where the braid 12 and the sheath 13 are peeled off.

Next, the terminals 3 will be described.

The terminals 3 are formed into the shape as shown in FIG. 1 by processing a metal plate having conductivity. In the present embodiment, the terminals 3 are female terminals. As shown in FIG. 1, each terminal 3 has a conductor fastening portion 14 crimped onto the conductor of the signal wire 11 and an electric contact portion 15 arranged to contact a male terminal of a counterpart connector.

Next, the watertight plug 4 will be described.

The watertight plug 4 is a rubber plug molded of a synthetic resin having elasticity, and as shown in FIG. 1, is formed in a ring shape that is circular in cross section in the present embodiment.

On the outer peripheral surface of the watertight plug 4, a plurality of rips (projections) 16 are provided. While three rips are formed in the present embodiment, the present invention is not limited thereto. The lips 16 are provided circumferentially in a continuous ring shape.

Figure 10:
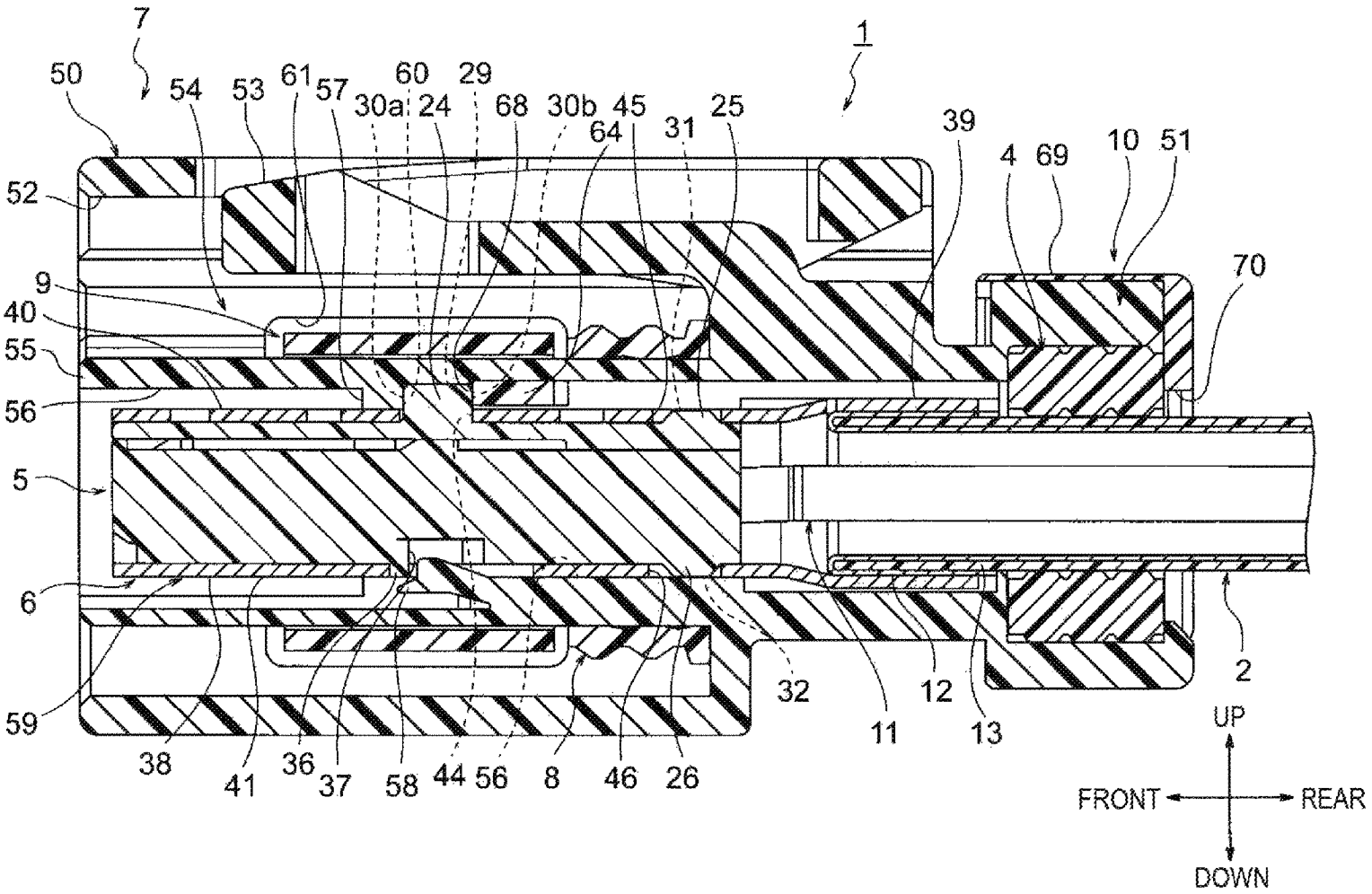
FIG. 10 is a cross-sectional view of a condition where the inner housing is accommodated in the outer housing in FIG. 9.

As shown in FIG. 10, when attached to a watertight plug attaching portion 51 described later, the lips 16 are in contact with the inside of the watertight plug attaching portion 51 of the outer housing 7 in a deformed state to enhance adhesion.

In a central portion of the watertight plug 4, a through hole 17 having substantially the same diameter as the outer periphery of the shielded cable 2 is formed.

As shown in FIG. 10, inserting the shielded cable 2 into the through hole 17 produces watertightness between the inner surface of the through hole 17 and the outer surface of the shielded cable 2.

Next, the inner housing 5 will be described.

Figure 2:
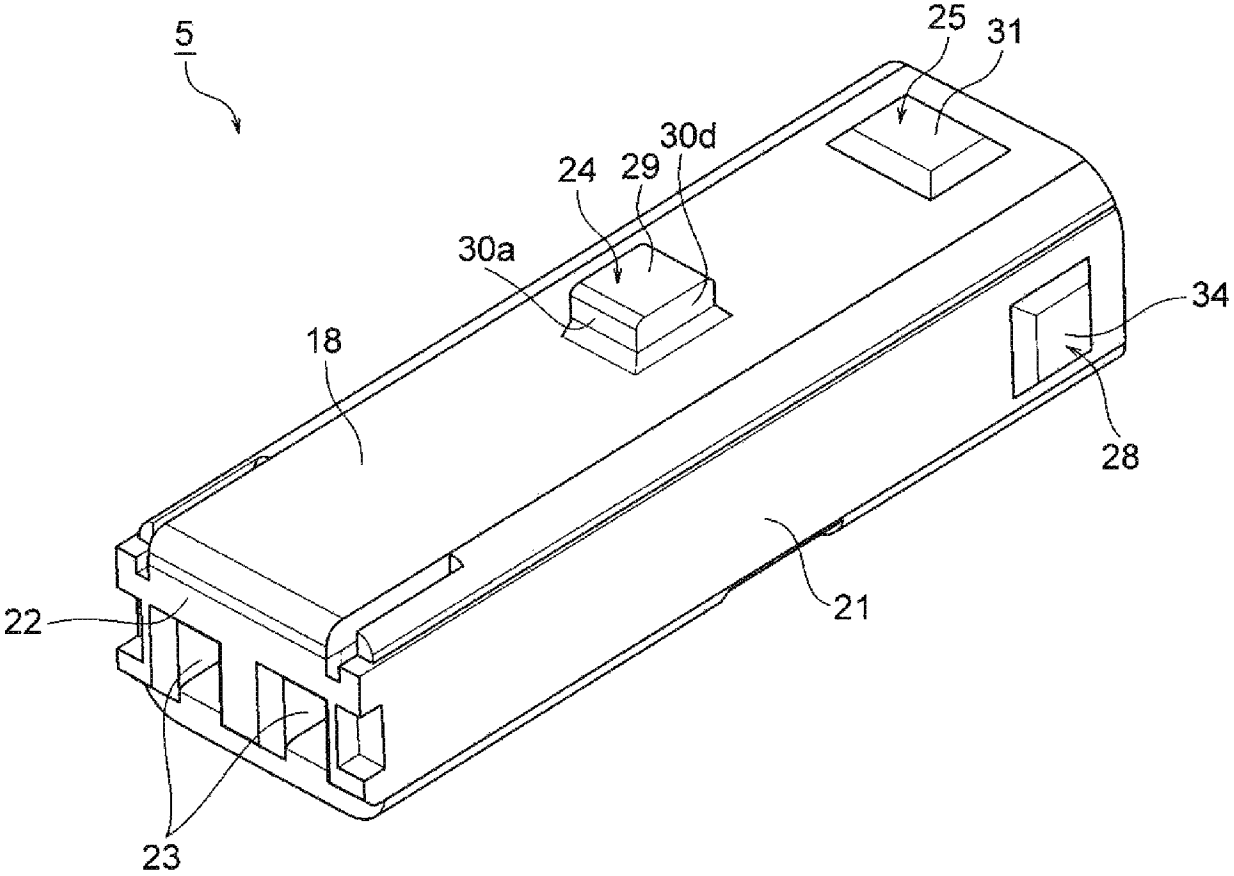
FIG. 2 is a perspective view of an inner housing.

The inner housing 5 is a molded piece made of a synthetic resin, and as shown in FIGS. 1 and 2, is formed substantially in a box shape. The inner housing 5 has an upper surface 18, a lower surface 19 (see FIG. 6B), a left side surface 20 (see FIG. 6B), a right side surface 21, a front surface 22 and a non-illustrated back surface. Inside the inner housing 5, a plurality of cavities 23 is provided to accommodate and hold the terminals 3 crimped onto the respective ends of the signal wires 11. The inner housing 5 is configured such that the shielding shell 6 is detachably attachable to its outer periphery.

Between the inner housing 5 and an inner surface 56 of an inner housing holding portion 55 of the outer housing 7 (see FIGS. 10 and 11), "looseness suppressing structure" is provided. The looseness suppressing structure is configured to allow the inner housing 5 to be held inside the inner housing holding portion 55 without looseness when the shielding shell 6 is attached (see FIG. 10) and also when the shielding shell 6 is not attached (see FIG. 11).

The looseness suppressing structure includes at least one looseness suppressing protrusion. According to the example shown in FIGS. 1, 2, 6A and 6B, the at least one looseness suppressing protrusion includes a front upper surface looseness suppressing protrusion 24, a rear upper surface looseness suppressing protrusion 25, a rear lower surface looseness suppressing protrusion 26, a rear left side surface looseness suppressing protrusion 27, and a rear right side surface looseness suppressing protrusion 28. The looseness suppressing structure further includes an engagement protrusion 36. The protrusions 24, 25, 26, 27, 28, 36 are provided on the outer surface of the inner housing 5, more specifically, on the upper surface 18, the lower surface 19, the left side surface 20 and the right side surface 21 of the inner housing 5.

Figure 8A:
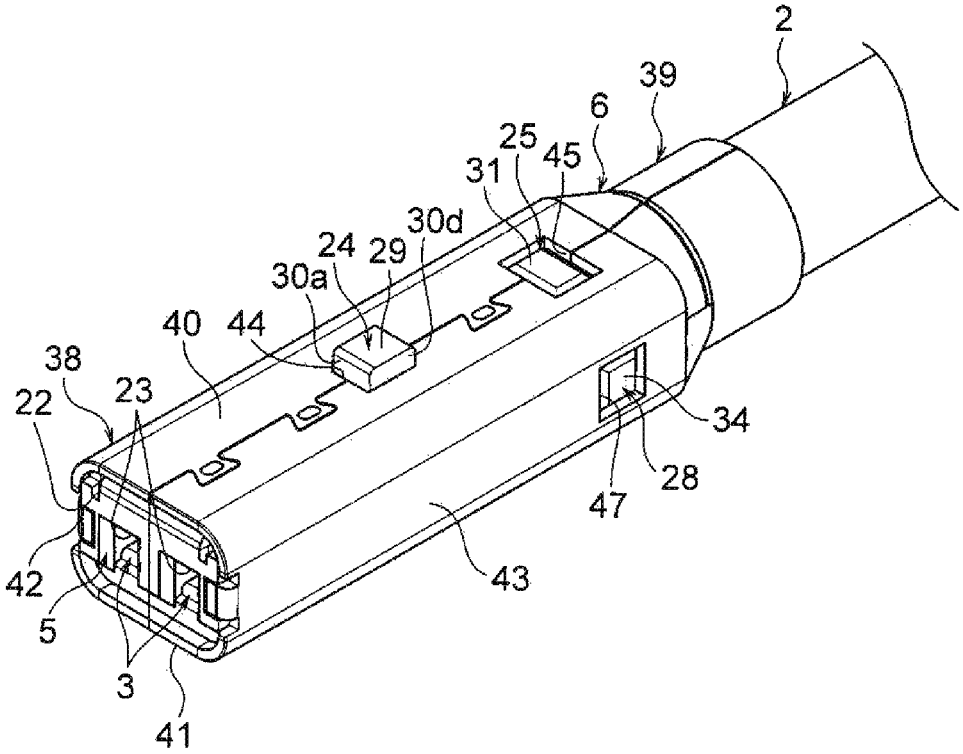
FIG. 8A is a perspective view of a condition where the shielding shell is attached to the inner housing in FIGS. 6A and 6B.
Figure 8B:
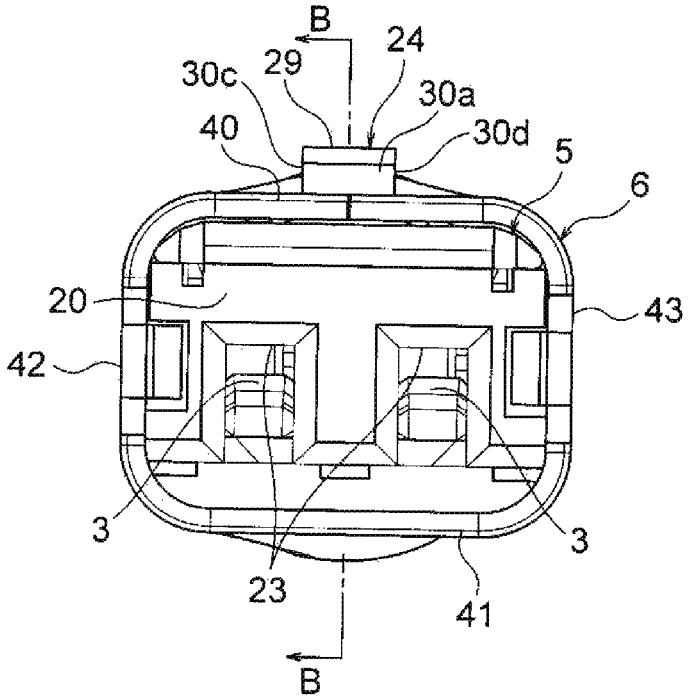
FIG. 8B is a front view of the inner housing of FIG. 8A.
Figure 9:
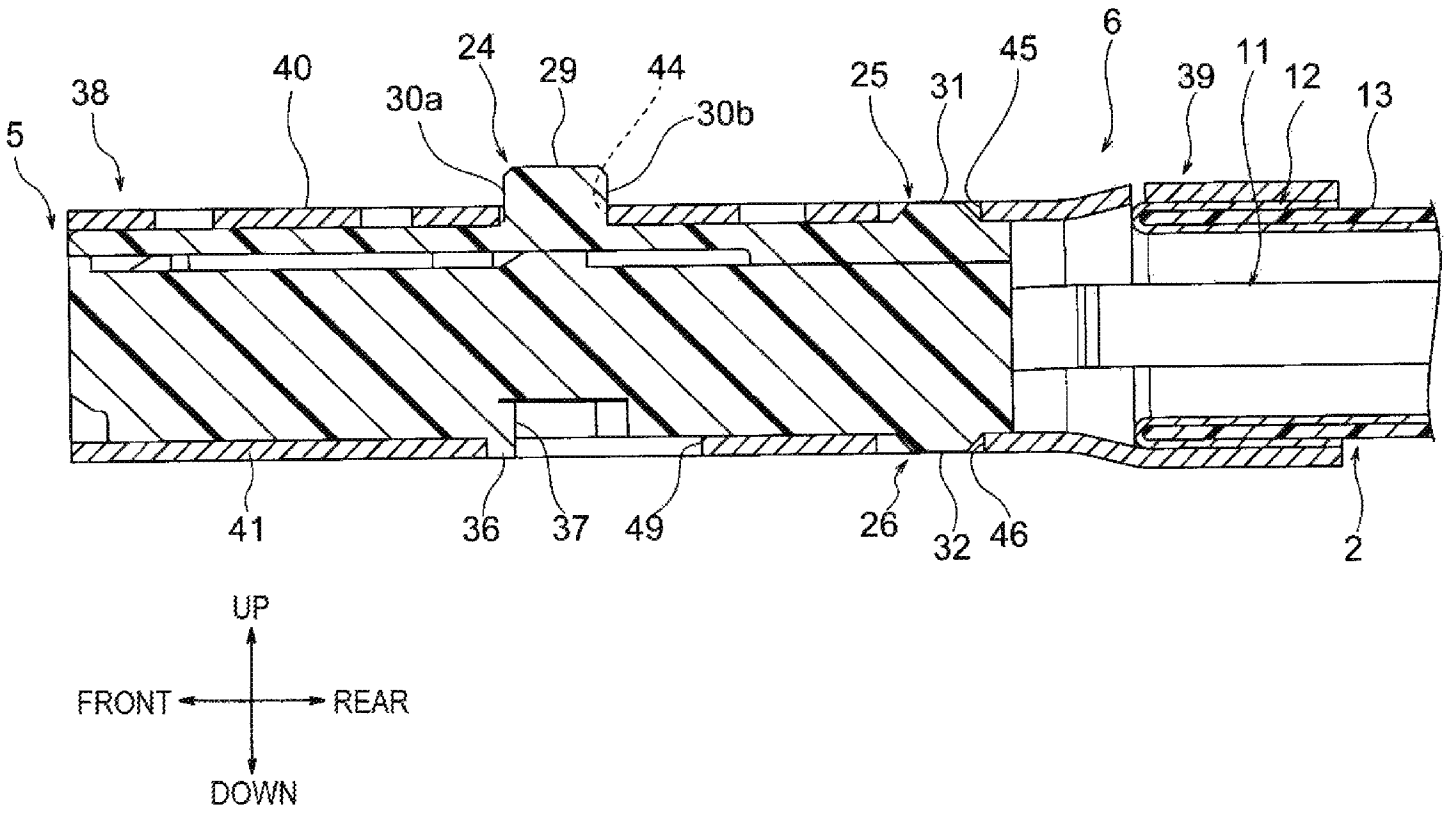
FIG. 9 is a cross-sectional view taken along the line B-B of FIG. 8B.

As shown in FIGS. 1 and 2, the front upper surface looseness suppressing protrusion 24 is disposed in a substantially middle part of the inner housing 5 in the axial direction (the front-rear direction in FIG. 1) on the upper surface 18 of the inner housing 5, and is configured such that it is rectangular in a plan view and convex. As shown in FIGS. 8A, 8B and 9, the front upper surface looseness suppressing protrusion 24 is formed so as to engage with a front upper surface engagement hole 44 when the shielding shell 6 is attached to the inner housing 5.

Figure 6A:
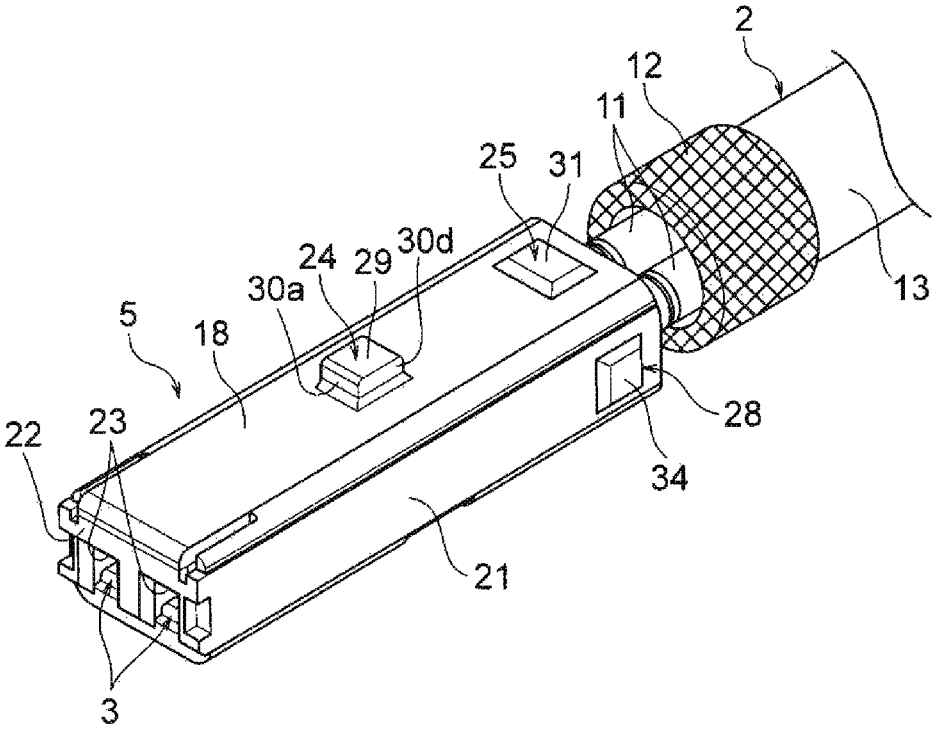
FIG. 6A is a perspective view of the inner housing connected to terminals of a shielded cable.
Figure 6B:
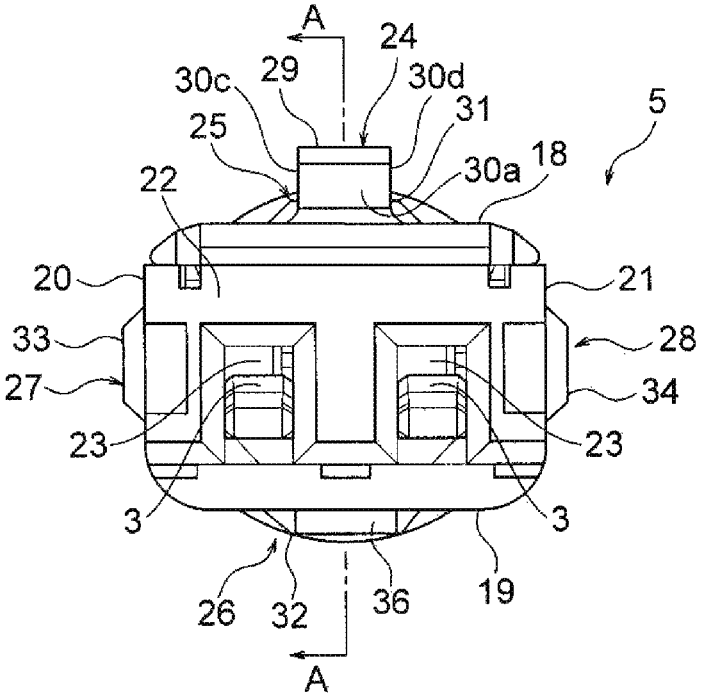
FIG. 6B is a front view of the inner housing of FIG. 6A.
Figure 11:
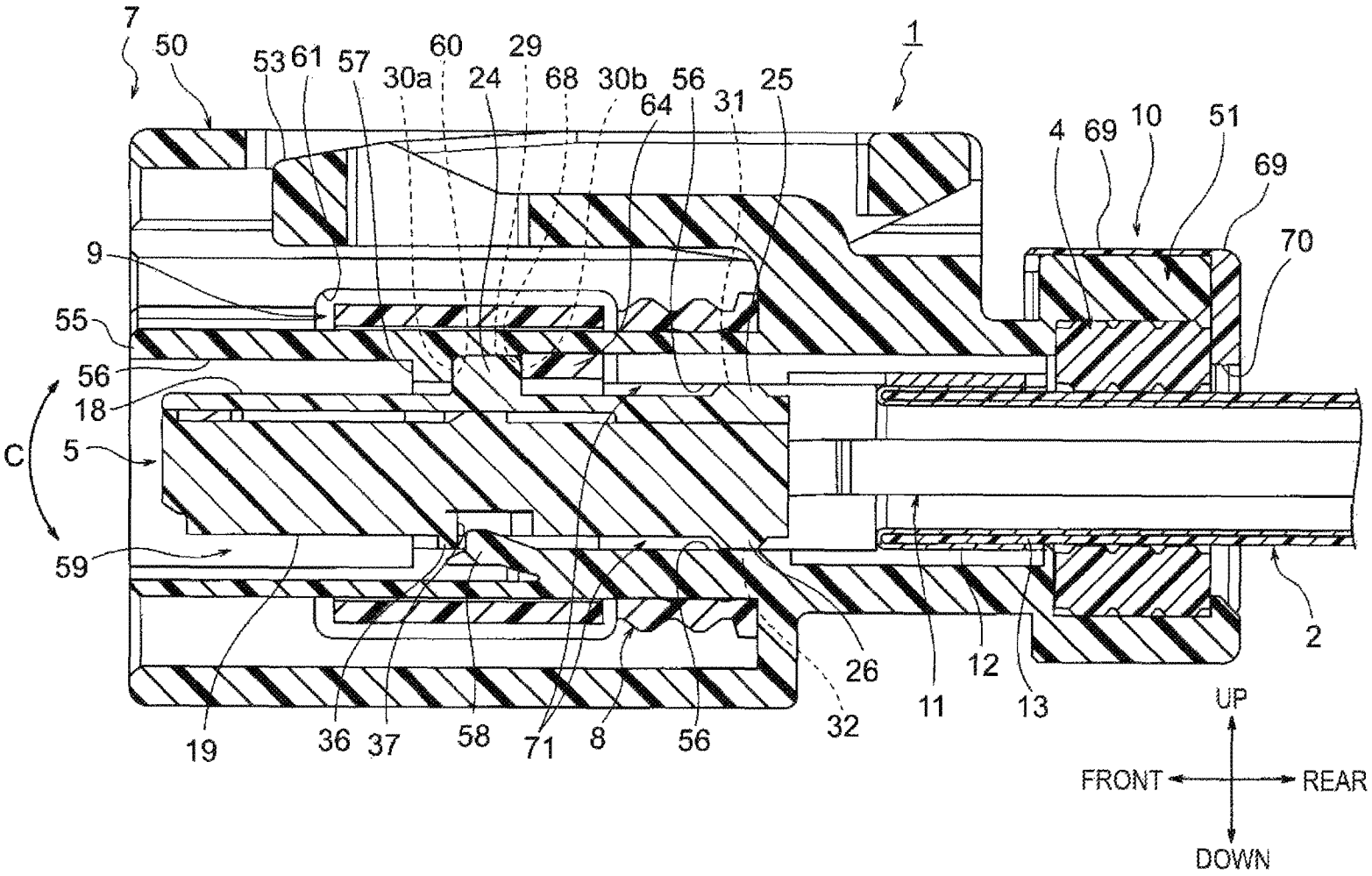
FIG. 11 is a cross-sectional view of a condition where the inner housing is accommodated in the outer housing in FIG. 7.

As shown in FIGS. 10 and 11, the front upper surface looseness suppressing protrusion 24 is configured to abut, when the inner housing 5 is accommodated in the inner housing holding portion 55, on the inner surface 56 of the inner housing holding portion 55 to suppress play of the inner housing 5 in the inner housing holding portion 55, in a state in which the shielding shell 6 is attached (see FIG. 10) and also in a state in which the shielding shell 6 is not attached (see FIG. 11). As shown in FIGS. 2, 6A and 6B, the front upper surface looseness suppressing protrusion 24 has a distal surface 29, a front surface 30*a*, a back surface 30*b*, a left side surface 30*c* and a right side surface 30*d*. As shown in FIGS. 10 and 11, the distal surface 29 is formed so as to be flat in conformity with the inner surface 56 of the inner housing holding portion 55. The front surface 30*a*, the back surface 30*b*, the left side surface 30*c* and the right side surface 30*d* are formed substantially orthogonally to the axial direction of the inner housing 5.

As shown in FIGS. 1 and 2, the rear upper surface looseness suppressing protrusion 25 is disposed near the axially rear end of the inner housing 5 on the upper surface 18 of the inner housing 5, and is configured such that it is rectangular in a plan view and convex. As shown in FIGS. 8A and 9, the rear upper surface looseness suppressing protrusion 25 is formed so as to engage with a rear upper surface engagement hole 45 when the shielding shell 6 is attached to the inner housing 5.

As shown in FIGS. 10 and 11, the rear upper surface looseness suppressing protrusion 25 is configured to abut, when the inner housing 5 is accommodated in the inner housing holding portion 55, on the inner surface 56 of the inner housing holding portion 55 to suppress play of the inner housing 5 in the inner housing holding portion 55 in a state in which the shielding shell 6 is attached (see FIG. 10) and also in a state in which the shielding shell 6 is not attached (see FIG. 11). The rear upper surface looseness suppressing protrusion 25 is configured such that its distal surface 31 is formed so as to be flat in conformity with the inner surface 56 of the inner housing holding portion 55. The rear upper surface looseness suppressing protrusion 25 has a tapered surface formed so as to connect the upper surface 18 of the inner housing 5 and the distal surface 31.

As shown in FIGS. 10 and 11, the rear lower surface looseness suppressing protrusion 26 is disposed near the axially rear end of the inner housing 5 on the lower surface 19 of the inner housing 5, and is configured such that it is rectangular in a plan view and convex. As shown in FIG. 9, the rear lower surface looseness suppressing protrusion 26 is formed so as to engage with a rear lower surface engagement hole 46 when the shielding shell 6 is attached to the inner housing 5.

As shown in FIGS. 10 and 11, the rear lower surface looseness suppressing protrusion 26 is configured to abut, when the inner housing 5 is accommodated in the inner housing holding portion 55, on the inner surface 56 of the inner housing holding portion 55 to suppress play of the inner housing 5 in the inner housing holding portion 55 in a state in which the shielding shell 6 is attached (see FIG. 10) and also in a state in which the shielding shell 6 is not attached (see FIG. 11). The rear lower surface looseness suppressing protrusion 26 is configured such that its distal surface 32 is formed so as to be flat in conformity with the inner surface 56 of the inner housing holding portion 55. The rear lower surface looseness suppressing protrusion 26 has a tapered surface formed so as to connect the lower surface 19 of the inner housing 5 and the distal surface 32.

As shown in FIG. 6B, the rear left side surface looseness suppressing protrusion 27 is disposed near the axially rear end of the inner housing 5 on the left side surface 20 of the inner housing 5, and is configured such that it is rectangular in a plan view and convex. The rear left side surface looseness suppressing protrusion 27 is formed so as to engage with a rear left side surface engagement hole (not illustrated in the drawings) when the shielding shell 6 is attached to the inner housing 5.

The rear left side surface looseness suppressing protrusion 27 is configured such that to abut, when the inner housing 5 is accommodated in the inner housing holding portion 55, on the inner surface 56 of the inner housing holding portion 55 to suppress play of the inner housing 5 in the inner housing holding portion 55 in a state in which the shielding shell 6 is attached (see FIG. 10) and also in a state in which the shielding shell 6 is not attached (see FIG. 11). The rear left side surface looseness suppressing protrusion 27 is configured such that its distal surface 33 is formed so as to be flat in conformity with the inner surface 56 of the inner housing holding portion 55. The rear left side surface looseness suppressing protrusion 27 has a tapered surface formed so as to connect the left side surface 20 of the inner housing 5 and the distal surface 33.

As shown in FIG. 2, the rear right side surface looseness suppressing protrusion 28 is disposed near the axially rear end of the inner housing 5 on the right side surface 21 of the inner housing 5, and is configured such that it is rectangular in a plan view and convex. As shown in FIG. 8A, the rear right side surface looseness suppressing protrusion 28 is formed so as to engage with a rear right side surface engagement hole 47 when the shielding shell 6 is attached to the inner housing 5.

The rear right side surface looseness suppressing protrusion 28 is configured to abut, when the inner housing 5 is accommodated in the inner housing holding portion 55, on the inner surface 56 of the inner housing holding portion 55 to suppress play of the inner housing 5 in the inner housing holding portion 55, in a state in which the shielding shell 6 is attached (see FIG. 10) and also in a state in which the shielding shell 6 is not attached (see FIG. 11). The rear right side surface looseness suppressing protrusion 28 is configured such that its distal surface 34 is formed so as to be flat in conformity with the inner surface 56 of the inner housing holding portion 55. The rear right side surface looseness suppressing protrusion 28 has a tapered surface formed so as to connect the right side surface 21 of the inner housing 5 and the distal surface 34.

Figure 7:
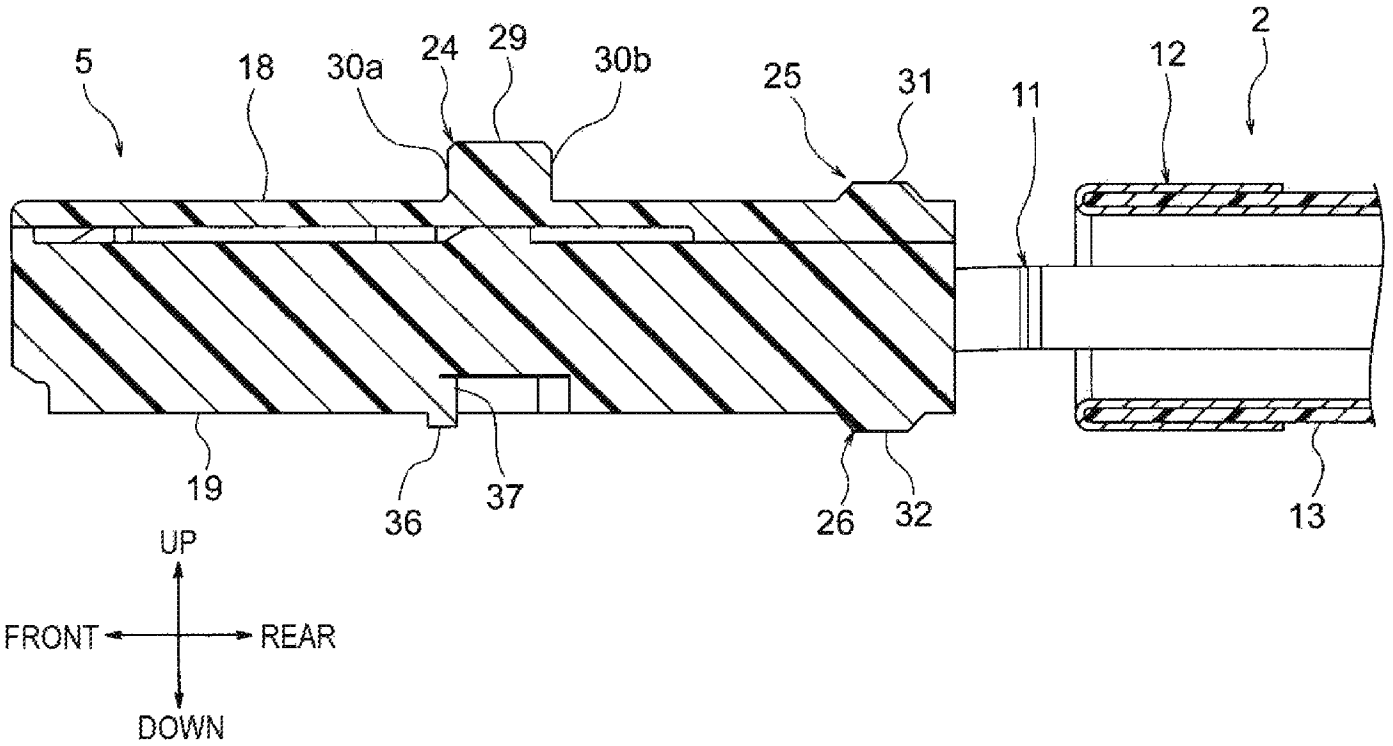
FIG. 7 is a cross-sectional view taken along the line A-A of FIG. 6B.

As shown in FIG. 7, the engagement protrusion 36 is disposed in a substantially middle part of the inner housing 5 in the axial direction (the front-rear direction in FIG. 7) on the lower surface 19 of the inner housing 5, and is configured such that it is convex. As shown in FIGS. 10 and 11, the engagement protrusion 36 is configured such that an engagement tongue 58 can engage therewith when the inner housing 5 is accommodated in the inner housing holding portion 55. The engagement protrusion 36 is configured to suppress play of the inner housing 5 in the inner housing holding portion 55 when the engagement tongue 58 engages with the engagement protrusion 36, irrespective of whether the shielding shell 6 is attached (see FIG. 10) or not attached (see FIG. 11).

As shown in FIG. 7, the inner housing 5 has an engagement tongue receiving recess 37 on the lower surface 19. The engagement tongue receiving recess 37 is disposed in a substantially axially middle part of the inner housing 5 on the lower surface 19 of the inner housing 5, and is configured such that it is convex. As shown in FIG. 10, the engagement tongue receiving recess 37 is configured such that part of the engagement tongue 58 is accommodated when the engagement tongue 58 engages with the engagement protrusion 36.

Next, the shielding shell 6 will be described.

Figure 3:
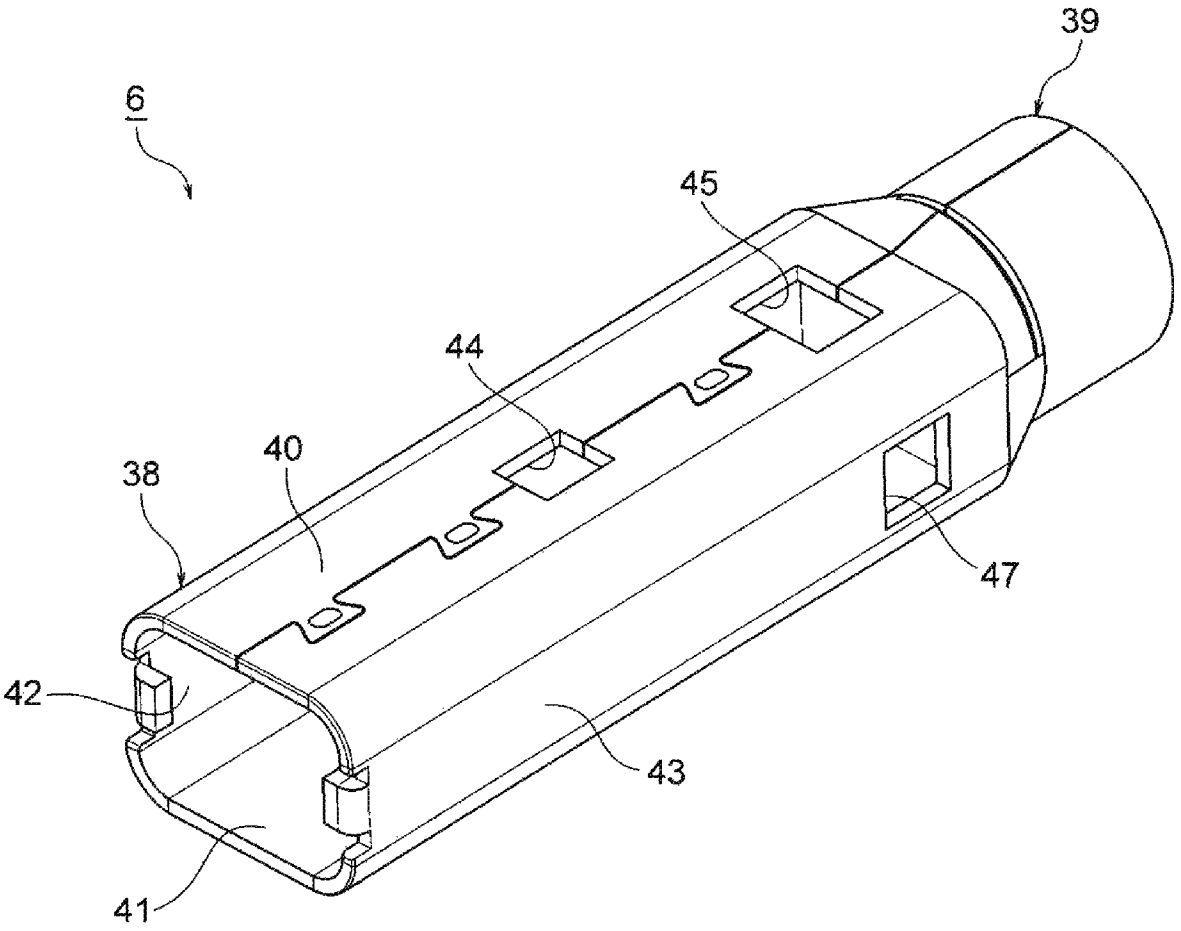
FIG. 3 is a perspective view of a shielding shell.

The shielding shell 6 is formed in a tubular shape as shown in FIGS. 1 and 3 by processing a metal plate having conductivity. The shielding shell 6 is detachably attached to the inner housing 5 depending on the transmission speed of the connector 1. Specifically, when the transmission speed is higher than 1 Gbps, the shielding shell 6 is attached to the inner housing 5, and when the transmission speed is 1 Gbps or lower, the shielding shell 6 is attached to the inner housing 5. The shielding shell 6 has a shielding portion 38 and a tightening portion 39.

The shielding portion 38 is formed in a square tubular shape that covers the outer periphery of the inner housing 5 by inserting the inner housing 5 thereinto. The shielding portion 38 has an upper surface 40, a lower surface 41, a left side surface 42 and a right side surface 43. The shielding portion 38 has at least one engagement hole. According to the example illustrated in FIGS. 3 and 9, the shielding portion 38 has a front upper surface engagement hole 44 and a rear upper surface engagement hole 45 provided through the upper surface 40, a rear lower surface engagement hole 46 provided through the lower surface 41, a rear left side surface engagement hole (not shown) provided through the left side surface 42, and a rear right side surface engagement hole 47 provided through the right side surface 43.

As shown in FIGS. 1 and 3, the front upper surface engagement hole 44 is disposed in a substantially middle part of the shielding portion 38 in the axial direction (the front-rear direction in FIG. 1) on the upper surface 40 of the shielding portion 38, and is formed so as to penetrate in a rectangular shape in a plan view. As shown in FIGS. 8A and 9, the front upper surface engagement hole 44 is configured such that the front upper surface looseness suppressing protrusion 24 engages therewith when the shielding shell 6 is attached to the inner housing 5.

As shown in FIGS. 1 and 3, the rear upper surface engagement hole 45 is disposed near the axially rear end of the shielding portion 38 on the upper surface 40 of the shielding portion 38, and is formed so as to penetrate in a rectangular shape in a plan view. As shown in FIGS. 8A and 9, the rear upper surface engagement hole 45 is configured such that the rear upper surface looseness suppressing protrusion 25 engages therewith when the shielding shell 6 is attached to the inner housing 5.

As shown in FIG. 9, the rear lower surface engagement hole 46 is disposed near the rear end of the shielding portion 38 in the axial direction (the front-rear direction in FIG. 9) on the lower surface 41 of the shielding portion 38, and is formed so as to penetrate in a rectangular shape in a plan view. The rear lower surface engagement hole 46 is configured such that the rear lower surface looseness suppressing protrusion 26 engages therewith when the shielding shell 6 is attached to the inner housing 5.

The rear left side surface engagement hole is disposed near the axially rear end of the shielding portion 38 on the left side surface 42 of the shielding portion 38, and is formed so as to penetrate in a rectangular shape in a plan view. The rear left side surface engagement hole is configured such that the rear left side surface looseness suppressing protrusion 27 engages therewith when the shielding shell 6 is attached to the inner housing 5.

As shown in FIGS. 1 and 3, the rear right side surface engagement hole 47 is disposed near the axially rear end of the shielding portion 38 on the right side surface 43 of the shielding portion 38, and is formed so as to penetrate in a rectangular shape in a plan view. The rear right side surface engagement hole 47 is configured such that the rear right side surface looseness suppressing protrusion 28 engages therewith when the shielding shell 6 is attached to the inner housing 5.

In addition, as shown in FIG. 9, an engagement tongue insertion hole 49 provided through the lower surface 41 of the shielding shell 6. The engagement tongue insertion hole 49 is formed so as to penetrate in a substantially axially middle part of the shielding portion 38. The engagement tongue insertion hole 49 is disposed and formed in a position where the engagement protrusion 36 engages therewith and that communicates with the engagement tongue receiving recess 37 when the shielding shell 6 is attached to the inner housing 5.

Next, the outer housing 7 will be described.

Figure 4:
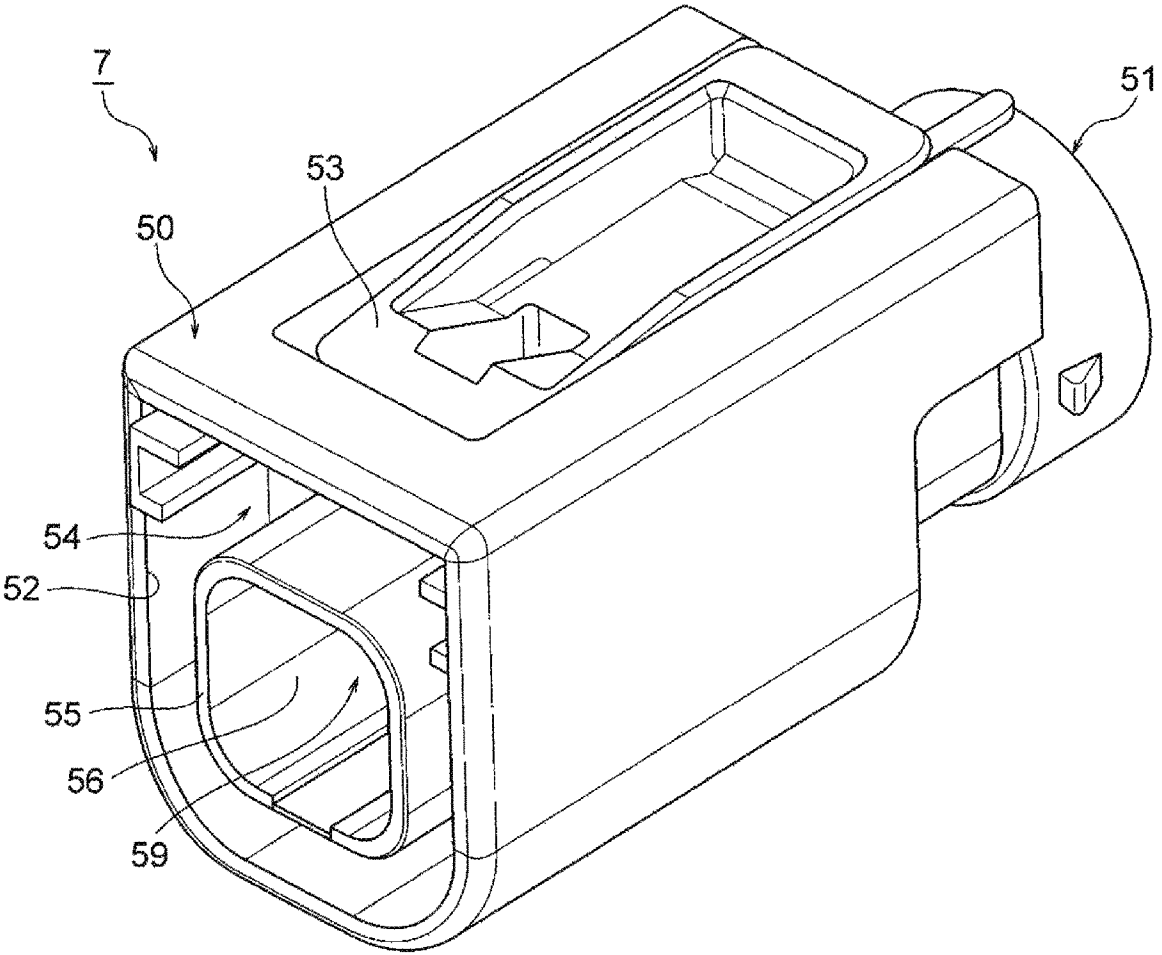
FIG. 4 is a perspective view of an outer housing.

The outer housing 7 is a molded piece made of a synthetic resin, and as shown in FIGS. 1 and 4, is formed in a tubular shape. The outer housing 7 has a hood portion 50 and the watertight plug attaching portion 51.

As shown in FIGS. 1 and 4, the hood portion 50 has its front surface opened as a counterpart connector insertion hole 52. The counterpart connector insertion hole 52 is configured such that a counterpart connector (not shown) can be inserted therethrough when the connector 1 is engaged with the counterpart connector. The hood portion 50 has on its upper surface an engagement arm 53 that engages with the counterpart connector and maintains the state of being engaged with the counterpart connector. As shown in FIG. 10, the hood portion 50 has on its side surface a locking member attaching hole 61 formed such that the locking member 9 can be attached thereto.

As shown in FIGS. 1 and 4, the hood portion 50 has inside a counterpart connector fitting space 54 and the inner housing holding portion 55. The counterpart connector fitting space 54 is formed as a space communicating with the counterpart connector insertion hole 52 and accommodating the counterpart connector when the connector 1 is engaged with the counterpart connector.

As shown in FIG. 10, the inner housing holding portion 55 extends from the counterpart connector insertion hole 52 to the neighborhood of the rear end of the hood portion 50 in the axial direction (the front-rear direction in FIG. 10) of the hood portion 50, and is formed in a square tubular shape. The inner housing holding portion 55 is configured such that the sealing member 8 is attached to the outside on the rear end side of the inner housing holding portion 55 in the axial direction (the front-rear direction in FIG. 10). The inner housing holding portion 55 has inside an inner housing movement restricting protrusion 57, the engagement tongue 58 and an inner housing holding chamber 59.

As shown in FIG. 10, the inner housing movement restricting protrusion 57 is disposed, on the inner surface 56 of the inner housing holding portion 55, in a position that is in a substantially axially middle part of the inner housing holding portion 55 and abuts on the front surface 30*a* of the front upper surface looseness suppressing protrusion 24 when the inner housing 5 is accommodated in the inner housing holding portion 55. The inner housing movement restricting protrusion 57 has on its rear end an abutment surface 60 formed substantially orthogonally to the axial direction of the inner housing holding portion 55.

As shown in FIG. 10, the engagement tongue 58 is disposed, on the inner surface 56 of the inner housing holding portion 55, in a position that is in a substantially axially middle part of the inner housing holding portion 55 and engages with the engagement protrusion 36 when the inner housing 5 is accommodated in the inner housing holding portion 55.

The inner housing holding chamber 59 is formed inside the inner housing holding portion 55, to provide a space that accommodates and holds the inner housing 5 inserted in the inner housing holding portion 55.

As shown in FIG. 10, the watertight plug attaching portion 51 is formed continuously with the rear end of the hood portion 50 such that the watertight plug 4 is fitted thereinside. The watertight plug attaching portion 51 is configured such that the rear cover 10 is fitted thereoutside.

Next, the sealing member 8 will be described.

The sealing member 8 is, for example, a gasket molded of a synthetic resin having elasticity, and is formed in a ring shape that is rectangular in cross section as shown in FIG. 1. As shown in FIG. 10, the sealing member 8 is configured such that it can be fitted to the outside of the inner housing holding portion 55.

On the outer peripheral surface of the sealing member 8, a plurality of rips (projections) 62 are provided. While two rips are formed in the present embodiment, the present invention is not limited thereto. The lips 62 are provided circumferentially in a continuous ring shape. The lips 62 are formed so as to enhance adhesion by coming into contact with the housing of the counterpart connector in an elastically deformed state.

Next, the locking member 9 will be described.

Figure 5:
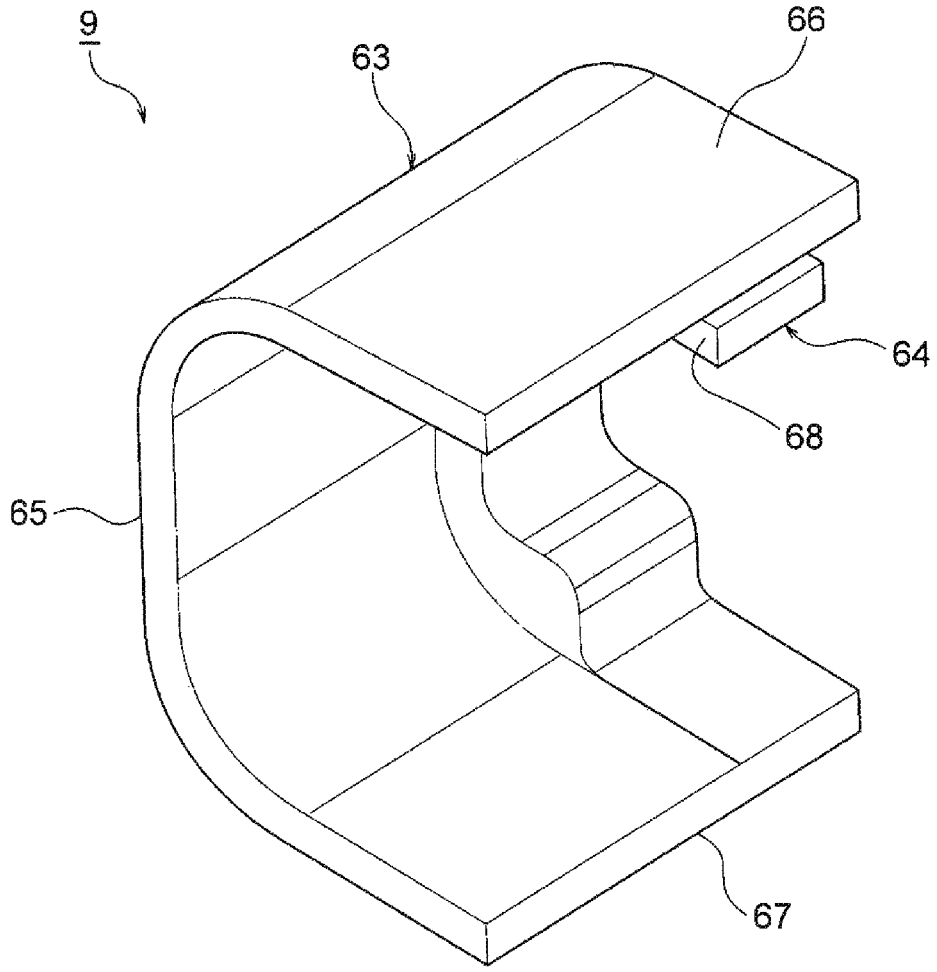
FIG. 5 is a perspective view of a locking member.

The locking member 9 is a molded piece made of a synthetic resin, and as shown in FIGS. 1 and 5, has a fitting portion 63 and a locking portion 64. As shown in FIG. 5, the fitting portion 63 has a curved wall 65, an upper wall 66 continuous with one end of the curved wall 65, and a lower wall 67 continuous with the other end of the curved wall 65. As shown in FIG. 10, the fitting portion 63 is configured such that it can be fitted in the locking member attaching hole 61 formed on the hood portion 50 of the outer housing 7.

As shown in FIG. 5, the locking portion 64 is provided inside the fitting portion 63, and is configured such that it is rectangular in cross section. The front surface of the locking portion 64 is formed as an abutment surface 68.

Next, the rear cover 10 will be described.

The rear cover 10 is a molded piece made of a synthetic resin, and as shown in FIGS. 1 and 10, has a fitting portion 69 and a cable insertion groove 70. The fitting portion 69 is configured such that it can be fitted to the outside of the watertight plug attaching portion 51 of the outer housing 7. The cable insertion groove 70 is formed in a rear part of the fitting portion 69 such that the shielded cable 2 is inserted thereinto.

Next, a procedure of assembly of the connector 1 including the shielding shell 6 (the shielding shell 6 is attached to the inner housing 5) and functions of the respective parts will be described.

First, as shown in FIG. 1, at the terminal portion of the shielded cable 2, the terminals 3 are fastened, by crimping, to the ends of the signal wires 11 that are exposed by peeling off the braid 12 and the sheath 13. To the shielded cable 2, the watertight plug 4 is fitted to the outside thereof in advance.

Then, the terminals 3 are inserted into the cavities 23 of the inner housing 5, and the terminals 3 are held inside the respective cavities 23 (see FIGS. 6A and 6B).

Thereafter, as shown in FIGS. 8A and 8B, the inner housing 5 is accommodated in the shielding portion 38 of the shielding shell 6 and the tightening portion 39 is swaged to electrically connect the shielding shell 6 and the braid 12 of the shielded cable 2. When the inner housing 5 is accommodated in the shielding portion 38 of the shielding shell 6, as shown in FIG. 9, the front upper surface looseness suppressing protrusion 24 of the inner housing 5 engages with the front upper surface engagement hole 44 of the shielding shell 6, the rear upper surface looseness suppressing protrusion 25 of the inner housing 5 engages with the rear upper surface engagement hole 45 of the shielding shell 6, and the rear lower surface looseness suppressing protrusion 26 of the inner housing 5 engages with the rear lower surface engagement hole 46 of the shielding shell 6. Moreover, when the inner housing 5 is accommodated in the shielding portion 38 of the shielding shell 6, although not specifically shown, the rear left side surface looseness suppressing protrusion 27 (see FIG. 6B) of the inner housing 5 engages with the rear left side surface engagement hole (not shown) of the shielding shell 6. Further, when the inner housing 5 is accommodated in the shielding portion 38 of the shielding shell 6, as shown in FIGS. 8A and 8B, the rear right side surface looseness suppressing protrusion 28 of the inner housing 5 engages with the rear right side surface engagement hole 47 of the shielding shell 6.

Then, as shown in FIG. 10, the inner housing 5 shown in FIGS. 8A, 8B and 9 is held inside the inner housing holding portion 55 of the outer housing 7. To accommodate the inner housing 5 in the inner housing holding portion 55, first, the inner housing 5 shown in FIGS. 8A, 8B and 9 is inserted from the rear end of the outer housing 7 (the watertight plug attaching portion 51) shown in FIG. 10, and is pushed toward the front end side of the outer housing 7. Then, when the engagement protrusion 36 of the inner housing 5 reaches a substantially axially middle part of the inner housing holding portion 55, the engagement tongue 58 of the inner housing holding portion 55 engages with the engagement protrusion 36 (primary locking). By the primary locking being made, the inner housing 5 can be held reliably inside the inner housing 55.

Moreover, when the primary locking is made, as shown in FIG. 10, the front surface 30*a* of the front upper surface looseness suppressing protrusion 24 abuts on the abutment surface 60 of the inner housing movement restricting protrusion 57, thereby preventing the movement of the inner housing 5 toward the front end side of the inner housing holding portion 55. For this reason, the front end of the inner housing holding portion 55 can be prevented from protruding to the outside of the inner housing holding portion 55.

After the primary locking is made, as shown in FIG. 10, the locking member 9 shown in FIG. 1 is fitted into the locking member attaching hole 61 of the outer housing 7 to lock the locking portion 64 to the front upper surface looseness suppressing protrusion 24 of the inner housing 5 (secondary locking). As shown in FIG. 10, by performing the secondary locking, the back surface 30*b* of the front upper surface looseness suppressing protrusion 24 abuts on the abutment surface 68 of the locking portion 64. Thereby, for example, in FIG. 10, even if the force of pulling the shielded cable 2 rearward acts to cause the shielded cable 2 to be pulled rearward, the movement of the inner housing 5 rearward (the pulling direction of the shielded cable 2) is restricted.

Thereafter, as shown in FIG. 10, to the watertight plug attaching portion 51 of the outer housing 7, the rear cover 10 is fitted so that the shielded cable 2 is inserted into the cable insertion groove 70. This completes the assembly of the connector 1. In the connector 1, as shown in FIG. 10, since the upper surface 40, the lower surface 41, the left side surface 42 (see FIGS. 8A and 8B) and the right side surface 43 (see FIGS. 8A and 8B) of the shielding portion 38 are in surface contact with the inner surface 56 of the inner housing holding portion 55, the inner housing 5 does not play in the vertical and horizontal directions (in FIG. 10, the direction penetrating from the front side toward the rear side of the paper) in the inner housing holding chamber 59.

Next, functions of the respective parts of the connector 1 not including the shielding shell 6 (the shielding shell 6 is not attached to the inner housing 5) will be described.

As shown in FIG. 11, in the connector 1, since the shielding shell 6 is not provided, a gap 71 corresponding to the thickness of the shielding shell 6 is formed between the upper surface 18, the lower surface 19, the left side surface 20 (see FIG. 6B) and the right side surface 21 (FIG. 6A) of the inner housing 5 and the inner surface 56 of the inner housing holding portion 55.

Here, as shown in FIG. 11, the front upper surface looseness suppressing protrusion 24 disposed on the front side of the inner housing 5 (in FIG. 11, in a substantially middle part of the inner housing 5 in the front-rear direction) abuts on the inner surface 56 of the inner housing holding portion 55 and the engagement tongue 58 of the inner housing holding portion 55 engages with the engagement protrusion 36 disposed on the front side of the inner housing 5, whereby the front upper surface looseness suppressing protrusion 24 and the engagement protrusion 36 act as support portions on the front side of the inner housing 5, so that play of the inner housing 5 in the vertical direction can be suppressed. Moreover, as shown in FIG. 11, the rear upper surface looseness suppressing protrusion 25, the rear lower surface looseness suppressing protrusion 26, the rear left side surface looseness suppressing protrusion 27 (see FIG. 6B) and the rear right side surface looseness suppressing protrusion 28 (FIG. 6A) disposed on the rear side of the inner housing 5 (in FIG. 11, near the rear end of the inner housing 5 in the front-rear direction) abut on the inner surface 56 of the inner housing holding portion 55, whereby the rear upper surface looseness suppressing protrusion 25, the rear lower surface looseness suppressing protrusion 26, the rear left side surface looseness suppressing protrusion 27 and the rear right side surface looseness suppressing protrusion 28 act as support portions on the rear side of the inner housing 5, so that play of the inner housing 5 in the vertical and horizontal directions (in FIG. 11, the direction penetrating from the front side toward the rear side of the paper) can be suppressed.

This connector 1 is capable of suppressing play of the inner housing 5 even when the shielding shell 6 is not attached to the inner housing 5 as described above. Therefore, the connector 1 can share the inner housing 5 and the outer housing 7 irrespective of the presence or absence of the shielding shell 6. From this, the connector 1 can handle both a case where the transmission speed is high (where it is higher than 1 Gbps) and a case where it is low (where it is 1 Gbps or lower) only by attaching or detaching the shielding shell 6. Consequently, the number of components of the connector 1 can be reduced.

Moreover, as shown in FIG. 11, the distal surface 29 of the front upper surface looseness suppressing protrusion 24, the distal surface 31 of the rear upper surface looseness suppressing protrusion 25, the distal surface 32 of the rear lower surface looseness suppressing protrusion 26, the distal surface 33 of the rear left side surface looseness suppressing protrusion 27 (see FIG. 6B) and the distal surface 34 of the rear right side surface looseness suppressing protrusion 28 (see FIG. 6A) are all formed so as to be flat in conformity with the inner surface 56 of the inner housing holding portion 55. For this reason, the distal surface 29 of the front upper surface looseness suppressing protrusion 24, the distal surface 31 of the rear upper surface looseness suppressing protrusion 25, the distal surface 32 of the rear lower surface looseness suppressing protrusion 26, the distal surface 33 of the rear left side surface looseness suppressing protrusion 27 (see FIG. 6B) and the distal surface 34 of the rear right side surface looseness suppressing protrusion 28 (see FIG. 6A) are all in surface contact with the inner surface 56 of the inner housing holding portion 55, whereby play of the inner housing 5 in the inner housing holding portion 55 can be stably suppressed.

Moreover, as shown in FIG. 11, since the front upper surface looseness suppressing protrusion 24 and the engagement protrusion 36 are disposed on the front side of the inner housing 5 and the rear upper surface looseness suppressing protrusion 25, the rear lower surface looseness suppressing protrusion 26, the rear left side surface looseness suppressing protrusion 27 (see FIG. 6B) and the rear right side surface looseness suppressing protrusion 28 (see FIG. 6A) are disposed on the rear side of the inner housing 5, play of the inner housing 5 is suppressed at the front side and the rear side of the inner housing. Therefore, even when, for example, a force that shakes the inner housing 5 in the direction C shown in FIG. 11 acts on the inner housing 5, play due to the action of such a force (play in a shaking manner) can be suppressed.

Further, as shown in FIG. 11, the front upper surface looseness suppressing protrusion 24 is held between the inner housing movement restricting protrusion 57 and the locking portion 64 of the locking member 9 for the secondary locking of the locking portion 64 to the front upper surface looseness suppressing protrusion 24 of the inner housing 5. Thereby, for example, as shown in FIG. 11, not only the movement of the inner housing 5 in the pulling direction of the shielded cable 2 when the shielded cable 2 is pulled rearward can be restricted but play of the inner housing 5 in the inner housing holding portion 55 can be suppressed more reliably.

As described above with reference to the drawings, according one or more exemplary embodiments of the present invention, the connector 1 can be provided in which the inner housing 5 is held inside the outer housing 7 without looseness irrespective of the presence or absence of the shielding shell 6 and the number of components can be reduced by sharing the inner housing 5 and the outer housing 7.

While the present invention has been described with reference to certain exemplary embodiments thereof, the scope of the present invention is not limited to the exemplary embodiments described above, and it will be understood by those skilled in the art that various changes and modifications may be made therein without departing from the scope of the present invention as defined by the appended claims.

What is claimed is:

1. A connector comprising:

an inner housing configured to hold terminals inside the inner housing, the terminals being crimped onto respective ends of a plurality of signal wires;

a shielding shell formed in a tubular shape that is attachable to the inner housing; and an outer housing comprising an inner housing holding portion configured to hold the inner housing inside the inner housing holding portion, wherein the shielding shell is configured to be attached to the inner housing or detached from the inner housing depending on a transmission speed of the connector, wherein the inner housing comprises a looseness suppressing structure between the inner housing and an inner surface of the inner housing holding portion, the looseness suppressing structure being configured to allow the inner housing to be held inside the inner housing holding portion without looseness when the shielding shell is attached to the inner housing and also when the shielding shell is not attached to the inner housing.

2. The connector according to claim 1, wherein the shielding shell comprises at least one engagement hole provided through an outer surface of the shielding shell, and wherein the looseness suppressing structure comprises at least one looseness suppressing protrusion provided on an outer surface of the inner housing, the at least one looseness suppressing protrusion being configured to engage with the at least one engagement hole when the shielding shell is attached to the inner housing and to abut on the inner surface of the inner housing holding portion to suppress play of the inner housing when the inner housing is accommodated inside the inner housing holding portion.

3. The connector according to claim 2, wherein the at least one looseness suppressing protrusion comprises a plurality of looseness suppressing protrusions provided on the outer surface of the inner housing and arranged along an axial direction of the inner housing.

4. The connector according to claim 2, wherein the inner surface of inner housing holding portion comprises a flat surface portion, and wherein the at least one looseness suppressing protrusion comprises a flat distal surface that conforms to the flat surface portion of the inner surface of the inner housing holding portion.

5. The connector according to claim 1, wherein the looseness suppressing structure comprises an engagement protrusion provided on an outer surface of the inner housing, and wherein the outer housing comprises an engagement tongue provided on the inner surface of the inner housing holding portion to engage with the engagement protrusion.

6. The connector according to claim 2, further comprising a locking member attachable to the inner housing and the outer housing, wherein the locking member comprises a locking portion configured to abut, when the locking member is attached to the inner housing and the outer housing, on the at least one looseness suppressing protrusion to lock the at least one looseness suppressing protrusion.

* * * * *